US008713745B2

(12) United States Patent
Szablewski

(10) Patent No.: US 8,713,745 B2
(45) Date of Patent: May 6, 2014

(54) THICK AND THIN ICE SCRAPER

(75) Inventor: Chad Edward Szablewski, Columbia, TN (US)

(73) Assignee: Chad Edward Szablewski, Columbia, TN (US)

( * ) Notice: Subject to any disclaimer, the term of this patent is extended or adjusted under 35 U.S.C. 154(b) by 35 days.

(21) Appl. No.: 13/417,210

(22) Filed: Mar. 10, 2012

(65) Prior Publication Data

US 2012/0279006 A1 Nov. 8, 2012

Related U.S. Application Data

(60) Provisional application No. 61/457,654, filed on May 6, 2011.

(51) Int. Cl.
*A47L 13/02* (2006.01)
*A47L 13/08* (2006.01)

(52) U.S. Cl.
USPC ..... 15/236.02; 15/236.05; 15/236.07

(58) Field of Classification Search
USPC ..... 15/236.01, 236.02, 236.05, 236.07; D32/49
See application file for complete search history.

(56) References Cited

U.S. PATENT DOCUMENTS 4,422,206 A * 12/1983 Brace et al. ..... 15/236.02
5,101,529 A * 4/1992 Tippie ..... 15/236.02
5,179,754 A * 1/1993 Stradnick ..... 15/105
5,839,151 A * 11/1998 Whaley ..... 15/236.05

* cited by examiner

*Primary Examiner* — Randall Chin

(57) ABSTRACT

An ice scraper adapted to remove materials such as ice, frost, and/or snow from automobile window glass surfaces or other window glass surfaces that has a longitudinally extending handle composing of two separate ice scraping devices. The flat scraping device which is similar to most traditional ice scrapers is designed to remove thick ice and snow by applying force from the handle in a general parallel direction to the length of the handle against the surface to be scraped. The opposite or opposing side of the intermediate portion of the ice scraper body contains a double beveled edged circular shaped ice scraper designed to remove frost/thin ice using a clockwise or counter clockwise motion, utilizing the hand-hold or flat scraping surface or both as a handle. A handle composed of two angles that aid in the use of both the flat scraping device and circular working edge.

1 Claim, 4 Drawing Sheets

THICK AND THIN ICE SCRAPER

This application claims the benefit of U.S. Provisional Application No. 61/457,654, filed May 6, 2011.

BACKGROUND OF THE INVENTION

This invention relates to ice scrapers. More particularly this invention relates to traditional ice scrapers including a traditional triangle shaped angular scraping surface as well as a non-traditional circular/lid shaped ice scraper which is designed to speed up the scraping process. This circular shaped device not only covers more surface area at a much faster pace, but also does a much better job at handling thin frost and ice that a traditional scraper requires much more effort and time to remove.

The ice scraper can be made from any material, but the working edges are generally made of plastic. The working edge of the traditional ice scraper is straight in order to make direct contact with the glass surface as the circular ice scraper is on the opposite side requiring the handle to be made at an angle to best incorporate the use of both scrapers. The handle is tapered to provide a more substantial handhold and leverage for each of the aforementioned scraping devices. The ice scraper may be substantially planar, or may curve in a plane perpendicular to the line defined by the working edges. The circular shaped ice scraper can also be processed and sold separately to attach to existing ice scrapers if necessary by injection molding or machined fasteners or the ice scraper as a whole through the injection mold plastic process or any other material suitable to withstand the use intended.

Such ice scrapers can be molded as a single piece of plastic. More commonly however, the working edge is made from a hard material, such as polystyrene or methacrylate plastic. Such ice scrapers are frequently covered by a sleeve of preferably resilient material that is more comfortable to hold. The sleeve may be provided with a surface treatment on one, top, bottom, or all around to improve the user's grip. For example, grooves or a roughened surface may be provided.

Ice scrapers are frequently given away as promotional items by businesses. The businesses may want to imprint the ice scraper with advertising material as part of such a promotion. Imprint would preferably be done where there is no surface treatment. Different businesses may want different-sized imprints. At the same time, different surface treatments may provide different-sized areas for imprinting. For example, it may be best for the users grip to provide one surface that has surface treatment and one that does not; in such a case a larger imprint could be provided on the untreated surface or in the interior of the circular ice scraper, which does not contact the surface thus providing an area for any type of advertisement or promotion.

It would be desirable from a promotional point of view to have the imprint on the interior of the circular portion as the advertisement or display can be viewed while hanging on the shelf.

It could also be desirable to be able to provide the circular ice scraper as a separate entity if necessary, but in which the attachment to the handle would now become a handle.

SUMMARY OF THE INVENTION

It is an object of this invention to provide an ice scraper in which another circular scraper is mounted on the reverse side of the handle in order to create a dual scraper which can handle the breaking of thick ice with the traditional scraper and can increase the speed at which the user can scrape frost and thin ice from the surface by using the circular scraper which not only is an easier movement, but occupies much more surface area per revolution.

BRIEF DESCRIPTION OF DRAWINGS

The above and other objects and advantages of the invention will be evident upon consideration of the following specific description, taken along with the accompanying illustrations, in which reference characters refer to the like parts throughout, and in which.

DETAILED DESCRIPTION OF THE INVENTION

Figure 1:
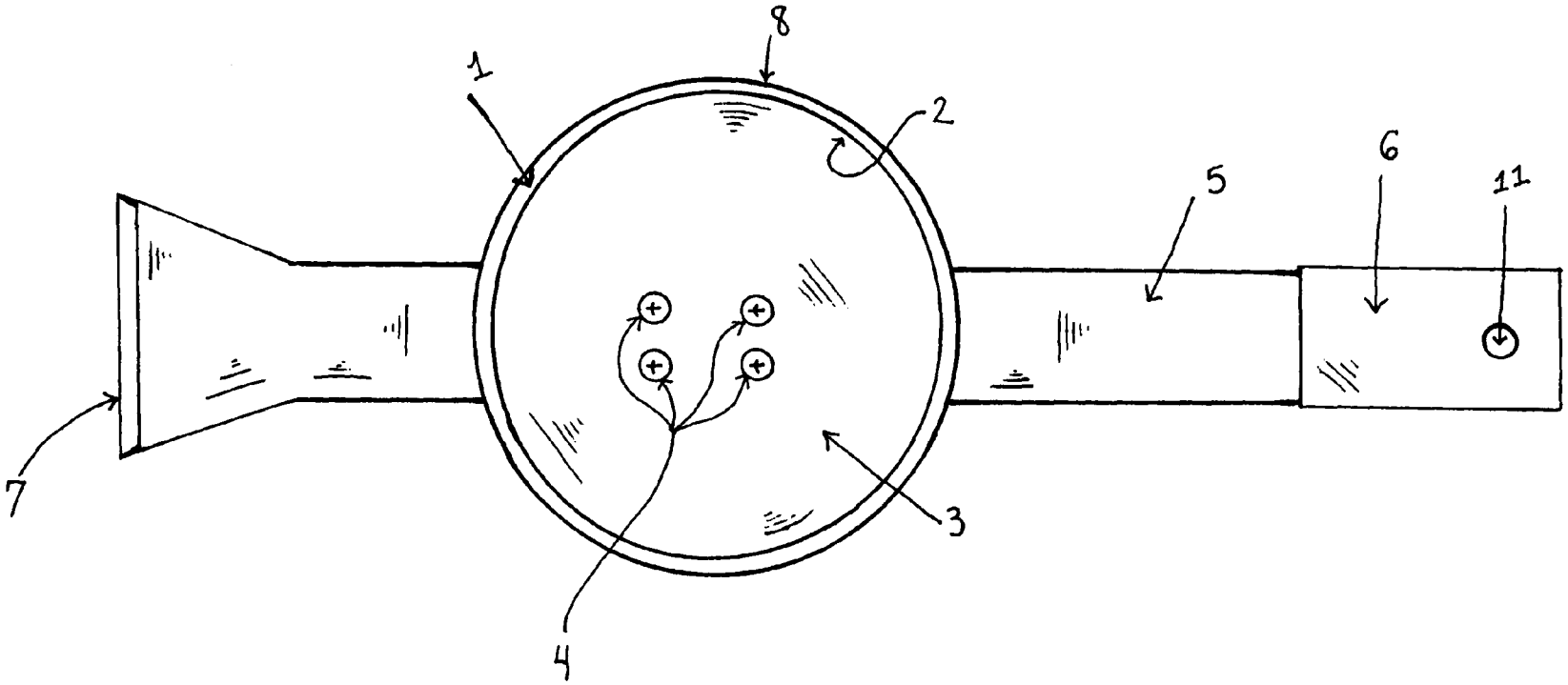
FIG. 1 is a perspective view of a preferred embodiment of an ice scraper according the present invention in a first configuration.

The present invention has a hole that extends through both sides of the ice scraper on the reverse side of the handhold from the combination of scraping devices.

In accordance with the invention the circular portion of the ice scraper preferably will be attached to the handhold through the use of injection molding or any other fastening device.

The circular or thin ice scraper has a lid shaped design and the width of the actual rim of the scraping edge will be sufficient to withstand the intended use. The depth of the edge to the bottom of the base of the circular scraper will also be sufficient to withstand intended use. The radius and diameter of said circular scraping device can be of any sufficient measure based upon the size of the corresponding handhold and traditional flat scraper. Preferably the connection point between the circular scraper and the handhold will be minute enough to allow for storage in behind seat compartments of automobiles without any difficulty.

The handhold extension can be of any intermediate length and the standard flat scraper should be said wider than the handhold to allow for maximum surface area coverage when scraping thick ice.

The invention will now be described with reference to FIGS. 1-4

The ice scraper has a body 5 including a possible treated handle 6, with a working edge 1 on the circular portion of the scraper, and a flat working edge 7. The body 5 may be made with any suitable material provided that working edges 1 and 7 is sufficiently hard enough to perform its function of removing ice and frost from the windshield. Preferably, body 5 is made from polystyrene, although it could be made from any hard plastic, or any other suitable material.

A circular scraping device base 3 is attached with the rim with an inside 2 and outside 8 designs as well as a strategic angle of contact 1. Aforementioned scraping device base 3 is mounted via 9 or 4. Also any other suitable mounting procedure could be used in order to alleviate the cost of the overall product.

A hole in the back or opposite side of scraping tools of the handhold 11 will be used for display on shelves and ease of hanging or storage by the sell, manufacturer, or consumer.

Figure 2:
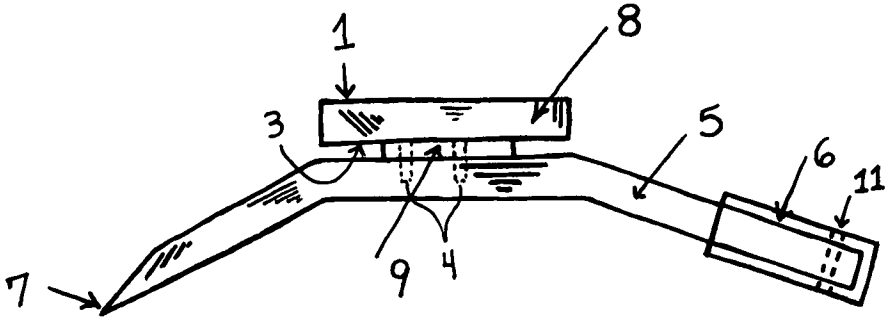
FIG. 2 is a side view perspective of ice scraper of FIG. 1.

As FIG. 2 is a side view that illustrates the angle of handhold 5 can vary to best suit the use of both scraping devices. Also the portion of 5 below 9 can be used to apply pressure along with handhold 6 in order to increase surface pressure while dislodging or removing ice. This portion under 9 could also be designed to ergonomically effect the effectiveness of the circular portion of the ice scraper via a better grip i.e. treatment or groove system.

Figure 3:
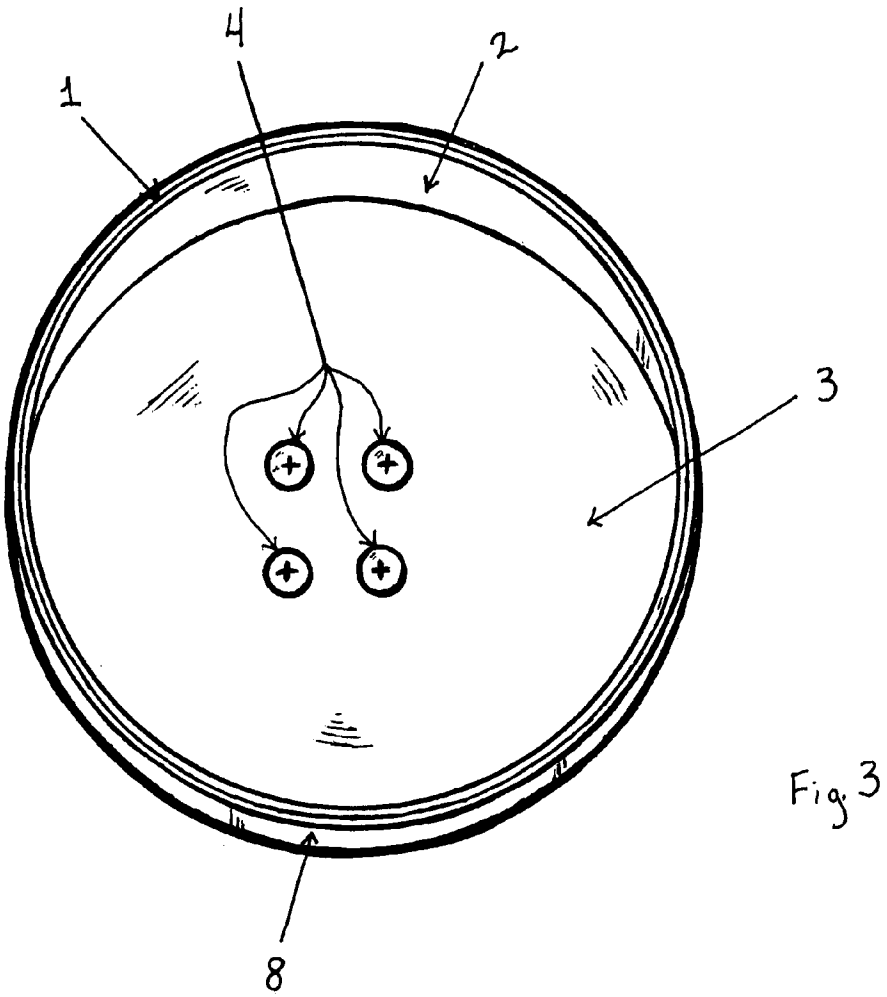
FIG. 3 is a plan view of the circular portion of the ice scraper of FIGS. 1 and 2

FIG. 3 is an exploded view of circular scraping device 3 with alternative possible mounting devices 4 to handhold 5. 8 being the outside rim of 3 as well as 2 being the inside rim 2. The depth of 8 will exceed that of 2 in order to give the base of 3 enough thickness to provide stability while providing the sufficient strength to perform its given function of removing ice and frost. The top of 2 and 8 is the actual angled scraping portion 1 and this can have a width that varies providing it is sufficient to withstand the rigors of scraping and removing ice without cracking or breaking said surface 1, 2, or 8. A small cutaway view in FIG. 3 shows 10 which is exploded and enlarged in FIG. 4.

Figure 4:
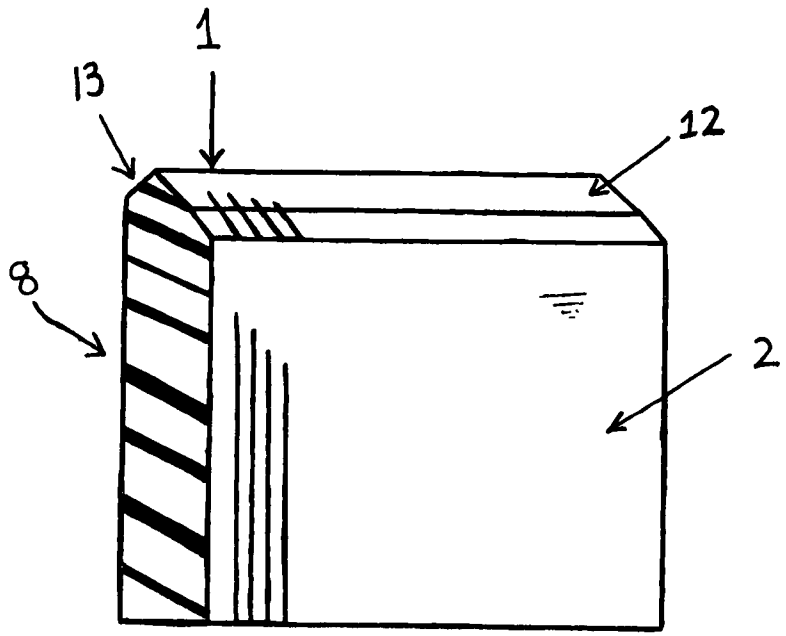
FIG. 4 is an exploded view of the scraping surface of the cross section of FIG. 3

FIG. 4 is an exploded or enlarged view of the cutaway section of 3 which is 10 from FIG. 3. It is illustrated that the angle and thickness has a design 11 that can vary to enhance strength and performance in use of the scraping edge 1.

Thus it is seen that an ice scraper with an additional circular scraper can be mounted to the handhold, but in which the circular scraper is a tool that can be manufactured per specifications of width and design in order to create optimum performance and alleviate scraping time by increasing surface area and ease of use. One skilled in the art will appreciate that the present invention can be practiced by other than the described embodiments, which are presented for purposes of illustration and not of limitation, and present the invention is limited only by the claims which follow.

The ice scraper of the present invention is suited to a person's normal positions and motions. Ergonomic features of the design, including treated grips, angle of the handhold, and depth or width of circular ice scraper, aid in the generation of scraping force from a person's natural positions and movements.

Other embodiments or embellishments of the present invention may include a larger handle with greater reach, and a telescoping or folding handle, which allow a user to scrape over longer distances, such as for large trucks and SUV's. It will be further understood that various other changes in the details, materials, and arrangements of the parts which have been described and illustrated in order to explain the nature of this invention may be made by those skilled in the art without departing from the scope of the invention as expressed in the following claims.

What is claimed is:

1. An ice scraper comprising an elongated body having a handhold at a proximal end of said elongated body and a flat working edge for scraping at an opposite distal end of said elongated body, said elongated body having a mounting bracket positioned intermediate said flat working edge and said handhold, said mounting bracket further supporting a circular working edge for scraping of cylindrical lid-shaped design defining a vertical outside surface and a vertical inside surface with a respective thickness therebetween for frost removal without cracking or breaking, said circular working edge further having a circular scraping device base, an interior beveled edge and an exterior beveled edge in radial circumference with said circular working edge, said circular scraping device base further having a plurality of mounting devices perpendicularly inserted therein for mounting said circular scraping device base to said mounting bracket, said mounting bracket providing vertical clearance of said circular working edge from said elongated body so that while in use said circular working edge and said vertical outside surface can be unobstructedly utilized, said circular working edge further defining a planar surface in side view, said elongated body on each side of said circular working edge forming a downward acute angle in order to increase surface pressure when using said flat working edge for scraping and to enable said flat working edge and said handhold to be used as handles to increase productivity of the circular working edge when used for scraping, and said interior beveled edge, said exterior beveled edge, said flat working edge, and said circular working edge all being made from molded plastic.

* * * * *

UNITED STATES PATENT AND TRADEMARK OFFICE

CERTIFICATE OF CORRECTION

PATENT NO. : 8,713,745 B2
APPLICATION NO. : 13/417210
DATED : May 6, 2014
INVENTOR(S) : Chad Edward Szablewski It is certified that error appears in the above-identified patent and that said Letters Patent is hereby corrected as shown below:

In the Specification:

Column 1, line 6, through Column 4, line 7, the specification should be deleted and replaced with the attached specification.

Signed and Sealed this
Twenty-ninth Day of July, 2014

Michelle K. Lee

Michelle K. Lee
*Deputy Director of the United States Patent and Trademark Office*

BACKGROUND OF THE INVENTION

This invention relates to ice scrapers. More particularly this invention relates to traditional ice scrapers including a traditional triangle shaped angular scraping surface as well as a non-traditional circular/lid shaped ice scraper which is designed to speed up the scraping process. This circular shaped device not only covers more surface area at a much faster pace, but also does a much better job at handling thin frost and ice that a traditional scraper requires much more effort and time to remove.

The ice scraper can be made from any material, but the working edges are generally made of plastic. The working edge of the traditional ice scraper is straight in order to make direct contact with the glass surface as the circular ice scraper is on the opposite side requiring the handle to be made at an angle to best incorporate the use of both scrapers. The handle is tapered to provide a more substantial handhold and leverage for each of the aforementioned scraping devices. The ice scraper may be substantially planar, or may curve in a plane perpendicular to the line defined by the working edges. The circular shaped ice scraper can also be processed and sold separately to attach to existing ice scrapers if necessary by injection molding or machined fasteners or the ice scraper as a whole through the injection mold plastic process or any other material suitable to withstand the use intended.

Such ice scrapers can be molded as a single piece of plastic. More commonly however, the working edge is made from a hard material, such as polystyrene or methacrylate plastic. Such ice scrapers are frequently covered by a sleeve of preferably resilient material that is more comfortable to hold. The sleeve may be provided with a surface treatment on one, top, bottom, or all around to improve the user's grip. For example, grooves or a roughened surface may be provided.

Ice scrapers are frequently given away as promotional items by businesses. The businesses may want to imprint the ice scraper with advertising material as part of such a promotion. Imprint would preferably be done where there is no surface treatment. Different businesses may want different-sized imprints. At the same time, different surface treatments may provide different-sized areas for imprinting. For example, it may be best for the users grip to provide one surface that has surface treatment and one that does not; in such a case a larger imprint could be provided on the untreated surface or in the interior of the circular ice scraper, which does not contact the surface thus providing an area for any type of advertisement or promotion.

It would be desirable from a promotional point of view to have the imprint on the interior of the circular portion as the advertisement or display can be viewed while hanging on the shelf.

It could also be desirable to be able to provide the circular ice scraper as a separate entity if necessary, but in which the attachment to the handle would now become a handle.

SUMMARY OF THE INVENTION

It is an object of this invention to provide an ice scraper in which another circular scraper is mounted on the reverse side of the handle in order to create a dual scraper which can handle the breaking of thick ice with the traditional scraper and can increase the speed at which the user can scrape frost and thin ice from the surface by using the circular scraper which not only is an easier movement, but occupies much more surface area per revolution.

BRIEF DESCRIPTION OF DRAWINGS

The above and other objects and advantages of the invention will be evident upon consideration of the following specific description, taken along with the accompanying illustrations, in which reference characters refer to the like parts throughout, and in which:

FIG. 1 is a perspective view of a preferred embodiment of an ice scraper according the present invention in a first configuration;

FIG.2 is a side view perspective of ice scraper of FIG. 1:

FIG.3 is a plan view of the circular portion of the ice scraper of FIGS. 1 and 2

FIG.4 is an exploded view of the scraping surface of the cross section of FIG. 3

DETAILED DESCRIPTION OF THE INVENTION

The present invention has a hole that extends through both sides of the ice scraper on the reverse side of the handhold from the combination of scraping devices.

In accordance with the invention the circular portion of the ice scraper preferably will be attached to the handhold through the use of injection molding or any other fastening device.

The circular or thin ice scraper has a lid shaped design and the width of the actual rim of the scraping edge will be sufficient to withstand the intended use. The depth of the edge to the bottom of the base of the circular scraper will also be sufficient to withstand intended use. The radius and diameter of said circular scraping device can be of any sufficient measure based upon the size of the corresponding handhold and traditional flat scraper. Preferably the connection point between the circular scraper and the handhold will be minute enough to allow for storage in behind seat compartments of automobiles without any difficulty.

The handhold extension can be of any intermediate length and the standard flat scraper should be said wider than the handhold to allow for maximum surface area coverage when scraping thick ice.

The invention will now be described with reference to FIGS. 1-4

The ice scraper has a body 5 including a possible treated handle 6, with a working edge 1 on the circular portion of the scraper, and a flat working edge 7. The body 5 may be made with any suitable material provided that working edges 1 and 7 is sufficiently hard enough to perform its function of removing ice and frost from the windshield. Preferably, body 5 is made from polystyrene, although it could be made from any hard plastic, or any other suitable material.

A circular scraping device base 3 is attached with the rim with an inside 2 and outside 8 designs as well as a strategic angle of contact 1. Aforementioned scraping device base 3 is mounted via 9 or 4. Also any other suitable mounting procedure could be used in order to alleviate the cost of the overall product.

A hole in the back or opposite side of scraping tools of the handhold 11 will be used for display on shelves and ease of hanging or storage by the sell, manufacturer, or consumer.

As FIG.2 is a side view that illustrates the angle of handhold 5 can vary to best suit the use of both scraping devices. Also the portion of 5 below 9 can be used to apply pressure along with handhold 6 in order to increase surface pressure while dislodging or removing ice. This portion under 9 could also be designed to ergonomically effect the effectiveness of the circular portion of the ice scraper via a better grip i.e. treatment or groove system.

FIG. 3 is an exploded view of circular scraping device 3 with alternative possible mounting devices 4 to handhold 5. 8 being the outside rim of 3 as well as 2 being the inside rim 2. The depth of 8 will exceed that of 2 in order to give the base of 3 enough thickness to provide stability while providing the sufficient strength to perform its given function of removing ice and frost. The top of 2 and 8 is the actual angled scraping portion 1 and this can have a width that varies providing it is sufficient to withstand the rigors of scraping and removing ice without cracking or breaking said surface 1, 2, or 8. A small cutaway view in Fig.3 shows 10 which is exploded and enlarged in FIG. 4.

FIG.4 is an exploded or enlarged view of the cutaway section of 3 which is 10 from FIG.3. It is illustrated that the angle and thickness has a design 11 that can vary to enhance strength and performance in use of the scraping edge 1.

Thus it is seen that an ice scraper with an additional circular scraper can be mounted to the handhold, but in which the circular scraper is a tool that can be manufactured per specifications of width and design in order to create optimum performance and alleviate scraping time by increasing surface area and ease of use. One skilled in the art will appreciate that the present invention can be practiced by other than the described embodiments, which are presented for purposes of illustration and not of limitation, and present the invention is limited only by the claims which follow.

The ice scraper of the present invention is suited to a person's normal positions and motions. Ergonomic features of the design, including treated grips, angle of the handhold, and depth or width of circular ice scraper, aid in the generation of scraping force from a person's natural positions and movements.

Other embodiments or embellishments of the present invention may include a larger handle with greater reach, and a telescoping or folding handle, which allow a user to scrape over longer distances, such as for large trucks and SUV's. It will be further understood that various other changes in the details, materials, and arrangements of the parts which have been described and illustrated in order to explain the nature of this invention may be made by those skilled in the art without departing from the scope of the invention as expressed in the following claims.

UNITED STATES PATENT AND TRADEMARK OFFICE

CERTIFICATE OF CORRECTION

PATENT NO. : 8,713,745 B2
APPLICATION NO. : 13/417210
DATED : May 6, 2014
INVENTOR(S) : Chad Edward Szablewski It is certified that error appears in the above-identified patent and that said Letters Patent is hereby corrected as shown below:

In the Specification:

Column 1, line 6, through Column 4, line 7, the specification should be deleted and replaced with the attached specification.

This certificate supersedes the Certificate of Correction issued July 29, 2014.

Signed and Sealed this
Eighteenth Day of November, 2014

Michelle K. Lee

Michelle K. Lee
*Deputy Director of the United States Patent and Trademark Office*

BACKGROUND OF THE INVENTION

This invention relates to ice scrapers. More particularly this invention relates to traditional ice scrapers including a flat working edge as well as a non-traditional circular working edge which is designed to speed up the scraping process. This circular working edge not only covers more surface area at a much faster pace, but also does a much better job at handling thin frost and ice that a traditional scraper with a flat working edge requires much more effort and time to remove. This particular ice scraper also utilizes the flat working edge as another handhold if necessary. The user can grip the handhold with one hand and flat working edge with the other in order to utilize the circular working edge with more surface pressure and control. The ice scraper can be made from any material, but the working edges are generally made of plastic. Such ice scrapers can be molded as a single piece of plastic. More commonly however, the working edge is made from a hard material, such as polystyrene or methacrylate plastic. Such ice scraper handholds are frequently covered by a sleeve of preferably resilient material that is more comfortable to hold. The sleeve may be provided with a surface treatment on one, top, bottom, or all around to improve the user's grip. For example, grooves or a roughened surface may be provided.

Ice scrapers are frequently given away as promotional items by businesses. These businesses may want to imprint or place an adhesive on the ice scraper with advertising material as part of such a promotion. Imprint would preferably be done where there is no surface treatment. Different businesses may want different-sized imprints. At the same time, different surface treatments may provide different-sized areas for imprinting. For example, it may be best for the imprint to occur on the untreated surface of the circular scraping device base, which does not contact the surface that contains the ice being scraped thus providing an area for any type of advertisement or promotion.

It would be desirable from a promotional point of view to have the imprint on the interior of the circular scraping device base, as the advertisement or display can be viewed while hanging on the shelf.

SUMMARY OF THE INVENTION

It is an object of this invention to provide an ice scraper in which another circular working edge is mounted on the reverse side of the body in order to create a dual scraper which can handle the breaking of thick ice with the traditional flat working edge and can increase the speed at which the user can scrape frost and thin ice from the surface by using the circular working edge which not only is an easier movement, but occupies much more surface area per revolution. While utilizing the circular working edge, the user can use both hands by gripping both the handhold and flat working edge to create more surface pressure on the area to be scraped.

BRIEF DESCRIPTION OF DRAWINGS

The above and other objects and advantages of the invention will be evident upon consideration of the following specific description, taken along with the accompanying illustrations, in which reference characters refer to the like parts throughout, and in which:

FIG. 1 is a perspective overhead view of a preferred embodiment of an ice scraper according the present invention in a first configuration;

FIG.2 is a side view perspective of ice scraper of FIG. 1:

FIG.3 is a plan view of the circular portion of the ice scraper of FIGS. 1 and 2.

FIG.4 is an exploded cross-section view of the circular working edge, outside vertical surface, inside vertical surface, interior beveled edge and exterior beveled edge.

DETAILED DESCRIPTION OF INVENTION

The present invention has a hole that extends through both sides of the ice scraper handhold and body.

The circular portion of the ice scraper has a lid shaped design and the width of the vertical outside surface and vertical inside surface of the circular working edge will be sufficient to withstand the intended use. The depth of the vertical outside surface and vertical inside surface terminating into circular scraping device base will also be sufficient to withstand intended use.

The radius and diameter of said circular working edge will be of sufficient measure based upon the size of the corresponding body and flat working edge. Preferably the distance between the circular working edge and the handhold will be minute enough to allow for storage in and behind seat compartments of automobiles without any difficulty.

The body can be of any intermediate length and the flat working edge will be said wider than the handhold to allow for maximum surface area coverage when scraping thick ice.

The invention will now be described with reference to FIGS. 1-4

FIG.1 illustrates the ice scraper has a body 5 including a handhold 6, with a circular working edge 1 on the circular portion of the scraper, and a flat working edge 7. The body 5 may be made with any suitable material provided that the circular working edge 1 and flat working edge 7 are sufficiently hard enough to perform its function of removing ice and frost from the surface it is being used upon. Preferably, body 5 is made from polystyrene, although it could be made from any hard plastic, or any other suitable material.

A circular scraping device base 3 contains both a vertical inside surface 2 and a vertical outside surface 8 which terminates vertically to circular working edge 1. A hole 11 will be through handhold 6 and body 5, and will be used for display on shelves and ease of hanging or storage by the seller, manufacturer, or consumer.

As FIG.2 is a side view that illustrates the angle of body 5 that best suits the use of both scraping devices. Originating from the handhold 6, the body 5 has a downward acute angle of about 20 degrees that occurs prior to vertical outside surface 8 to handhold 6. The angle terminates at this junction and creates a zero degree planar surface of body 5 which attached thereto is mounting bracket 9 and circular scraping device base 3. The second occurring acute angle of about 20 degrees in body 5 originates between flat working edge 7 and the nearest vertical outside surface 8. In addition, the section of body 5 in between mounting bracket 9 and handhold 6 can be used to apply pressure while utilizing handhold 6 in order to increase surface pressure while dislodging or removing ice while utilizing flat working edge 7. Gripping the flat working edge 7 along with handhold 6 will also increase surface pressure while utilizing the circular working edge 1. Aforementioned circular scraping device base 3 is mounted via mounting bracket 9 via mounting devices 4. Mounting devices 4 will be inserted through circular scraping device base 3, through mounting bracket 9, and terminate in body 5. Said mounting devices 4 terminate before exiting body 5 in order to maintain a continuously smooth surface. Mounting devices 4 also lie completely flush within circular scraping device base 3 in order to maintain a non protruding surface to possibly apply advertisement labeling. Said mounting devices 4 will be of a plastic or metal substance and Phillips head screws can serve this purpose contingent upon the mounting devices 4 do not damage the material in circular scraping device base 3, mounting bracket 9, and body 5.

FIG. 3 is an exploded view of circular scraping device base 3 with mounting devices 4. The vertical outside surface 8 being the outside rim of circular scraping device base 3 as well as vertical inside surface 2 being the inside rim of circular scraping device base 3 which creates a lid design. The length of vertical outside surface 8 will exceed that of vertical inside surface 2 in order to give the circular scraping device base 3 enough thickness to provide stability while providing the sufficient strength to perform its given function of removing ice and frost. The top of vertical inside surface 2 and vertical outside surface 8 is the circular working edge 1 and these will have a width that provides it to withstand the rigors of scraping and removing ice without cracking or breaking said circular working edge 1, vertical inside surface 2, vertical outside surface 8, or circular scraping device base 3.

FIG.4 is an exploded or enlarged view of the cutaway section of circular working edge 1. It is illustrated that circular working edge 1 has an interior beveled edge 12 and an exterior beveled edge 13 that enhances strength and performance in use of the circular working edge 1. The vertical inside surface 2 terminating vertically originates interior beveled edge 12 and the vertical outside surface 8 terminates vertically and originates exterior beveled edge 13.

Thus it is seen that an ice scraper with an additional circular working edge can be mounted to the body, but in which the circular working edge is a tool that can be manufactured per specifications of width and design in order to create optimum performance and alleviate scraping time by increasing surface area and ease of use. One skilled in the art will appreciate that the present invention can be practiced by other than the described embodiments, which are presented for purposes of illustration and not of limitation, and present the invention is limited only by the claims which follow.

The ice scraper of the present invention is suited to a person's normal positions and motions. Ergonomic features of the design, including treated grips, angles of the body, and depth or width of vertical inside and vertical outside surfaces in conjunction with the circular scraping device base aid in the generation of scraping force from a person's natural positions and movements.

Other embodiments or embellishments of the present invention may include a larger handle with greater reach, which allow a user to scrape over longer distances, such as for large trucks and SUV's. It will be further understood that various other changes in the details, materials, and arrangements of the parts which have been described and illustrated in order to explain the nature of this invention may be made by those skilled in the art without departing from the scope of the invention as expressed in the following claims.